US010634161B2

(12) United States Patent
Nakashima et al.

(10) Patent No.: US 10,634,161 B2
(45) Date of Patent: Apr. 28, 2020

(54) PROPELLER FAN, PROPELLER FAN DEVICE, AND AIR CONDITIONER OUTDOOR UNIT

(71) Applicant: Mitsubishi Electric Corporation, Tokyo (JP)

(72) Inventors: Seiji Nakashima, Tokyo (JP); Katsuyuki Yamamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 109 days.

(21) Appl. No.: 15/752,012

(22) PCT Filed: Sep. 8, 2015

(86) PCT No.: PCT/JP2015/075435
§ 371 (c)(1),
(2) Date: Feb. 12, 2018

(87) PCT Pub. No.: WO2017/042877
PCT Pub. Date: Mar. 16, 2017

(65) Prior Publication Data

US 2018/0238343 A1 Aug. 23, 2018

(51) Int. Cl.
*F04D 29/38* (2006.01)
*F04D 29/66* (2006.01)
(Continued)

(52) U.S. Cl.
CPC ..... *F04D 29/384* (2013.01); *F04D 29/545* (2013.01); *F04D 29/667* (2013.01);
(Continued)

(58) Field of Classification Search
None
See application file for complete search history.

(56) References Cited

U.S. PATENT DOCUMENTS 5,603,607 A * 2/1997 Kondo ..... F04D 29/384 415/119
2010/0266428 A1* 10/2010 Nakagawa ..... F04D 29/164 417/321
(Continued)

FOREIGN PATENT DOCUMENTS

CN 202628612 U 12/2012
CN 103047180 A 4/2013
(Continued)

OTHER PUBLICATIONS

Office Action dated Feb. 3, 2019 issued in corresponding Chinese patent application No. 2015800828202 (and English translation).
(Continued)

*Primary Examiner* — Michael Lebentritt
(74) *Attorney, Agent, or Firm* — Posz Law Group, PLC

(57) ABSTRACT

Provided is a propeller fan including a boss, and a blade fixed at an outer peripheral surface of the boss, wherein the blade has a second protrusion that protrudes toward a positive pressure surface side, at a trailing edge with respect to a rotation direction, the second protrusion is provided in a range on a radially outer side of a center of a radial distance from an inner peripheral end to an outer peripheral end of the blade, and has a protrusion tip end with a maximum protrusion height, a first base at a starting part of protrusion on a radially inner side of the protrusion tip end, and a second base at a starting part of protrusion on a radially outer side of the protrusion tip end, and the protrusion tip end is positioned nearer to the second base than to the first base in the radial direction.

13 Claims, 3 Drawing Sheets

(51) Int. Cl.

| | |
|---|---|
| ***F04D 29/68*** | (2006.01) |
| ***F24F 13/24*** | (2006.01) |
| ***F24F 1/06*** | (2011.01) |
| ***F04D 29/54*** | (2006.01) |
| ***F04D 29/70*** | (2006.01) |
| ***F24F 1/38*** | (2011.01) |

(52) U.S. Cl.
CPC ..... *F04D 29/681* (2013.01); *F04D 29/703* (2013.01); *F24F 1/06* (2013.01); *F24F 1/38* (2013.01); *F24F 13/24* (2013.01); *F05D 2240/303* (2013.01); *F05D 2240/304* (2013.01)

(56) References Cited

U.S. PATENT DOCUMENTS

2011/0200445 A1* 8/2011 Takeda ..... F04D 29/38 416/223 R
2013/0091888 A1 4/2013 Park et al.
2014/0086754 A1* 3/2014 Seiji ..... F04D 29/384 416/237
2014/0338388 A1* 11/2014 Kim ..... F04D 29/384 62/426
2017/0089322 A1* 3/2017 Liu ..... F03B 3/04

FOREIGN PATENT DOCUMENTS

| | | | |
|---|---|---|---|
| EP | 2 230 407 | A1 | 9/2010 |
| JP | S-61-33276 | | 9/1986 |
| JP | 08-284887 | A | 10/1996 |
| JP | 2010-144702 | A | 7/2010 |
| WO | 2015/030048 | A1 | 3/2015 |

OTHER PUBLICATIONS

Extended EP Search Report dated Aug. 16, 2018 issued in corresponding EP patent application No. 15903543.5.
International Search Report of the International Searching Authority dated Dec. 1, 2015 for the corresponding international application No. PCT/JP2015/075435 (and English translation).

* cited by examiner

PROPELLER FAN, PROPELLER FAN DEVICE, AND AIR CONDITIONER OUTDOOR UNIT

CROSS REFERENCE TO RELATED APPLICATION

This application is a U.S. national stage application of PCT/JP2015/075435 filed on Sep. 8, 2015, the disclosure of which is incorporated herein by reference.

TECHNICAL FIELD

The present invention relates to a propeller fan, a propeller fan device, and an air conditioner outdoor unit.

BACKGROUND ART

A conventional propeller fan has a shape as follows. Specifically, in a fan including a rotary boss and a plurality of blades radially provided at the outer periphery of the boss, an attachment angle for an intermediate part of each blade is greater than an attachment angle for a root part of the blade and an attachment angle for a tip end of the blade.

CITATION LIST

Patent Literature

[PTL 1] Japanese Patent Application Publication No. H08-284887

SUMMARY OF INVENTION

Technical Problem

According to a technique disclosed in PTL 1, the fan is not configured to homogenize the wind velocity distribution of flow blown out from the fan, and the presence of any structure such as a grill downstream of the fan prevents a sufficient noise reduction effect from being provided.

With the foregoing in view, it is an object of the present invention to provide a propeller fan with reduced noise.

Solution to Problem

In order to achieve the object, a propeller fan according to the present invention includes a boss that rotates around a rotation axis, and a blade fixed at an outer peripheral surface of the boss, wherein the blade has a first protrusion that protrudes toward a negative pressure surface side, at a leading edge with respect to a rotation direction, the first protrusion is provided in a range on a radially outer side of a center of a radial distance from an inner peripheral end to an outer peripheral end of the blade, and has a protrusion tip end with a maximum protrusion height, a first base at a starting part of protrusion on a radially inner side of the protrusion tip end, and a second base at a starting part of protrusion on the radially outer side of the protrusion tip end, and the protrusion tip end is positioned nearer to the second base than to the first base in the radial direction.

Advantageous Effects of Invention

According to the present invention, a deviation in the wind velocity downstream of the fan can be reduced, so that the noise can be reduced.

DESCRIPTION OF EMBODIMENTS

Figure 1:
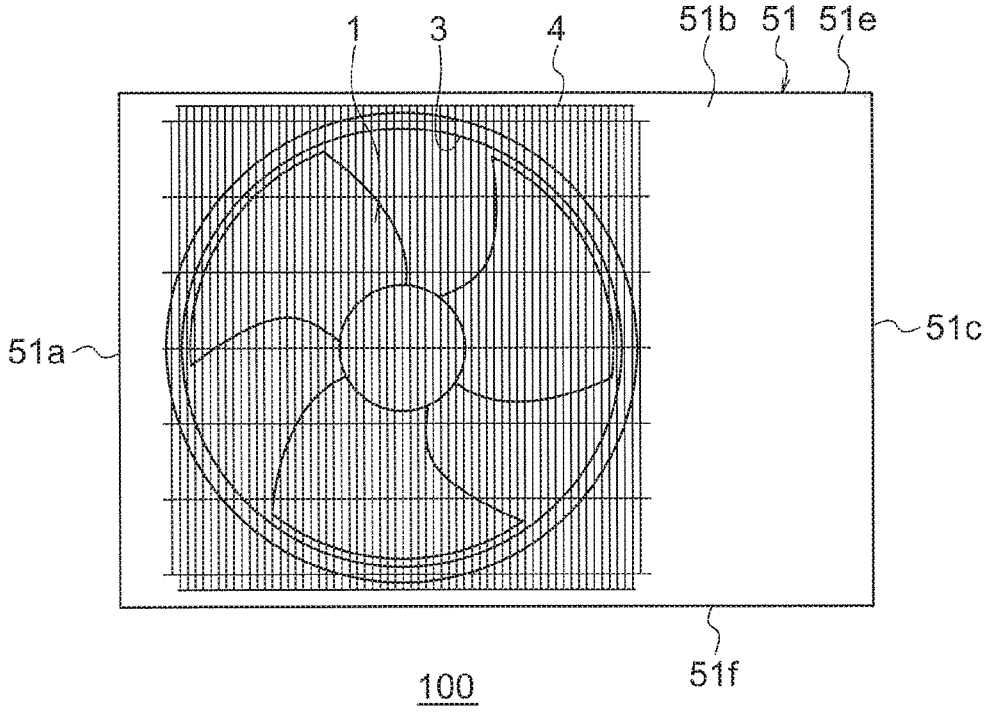
FIG. 1 is a front view of an air conditioner outdoor unit according to a first embodiment of the present invention.

Hereinafter, embodiments of the present invention will be described in conjunction with accompanying drawings. Note that the same reference characters designate the same or corresponding portions. A single blade designated by a reference character collectively represents a plurality of blades.

First Embodiment

Figure 2:
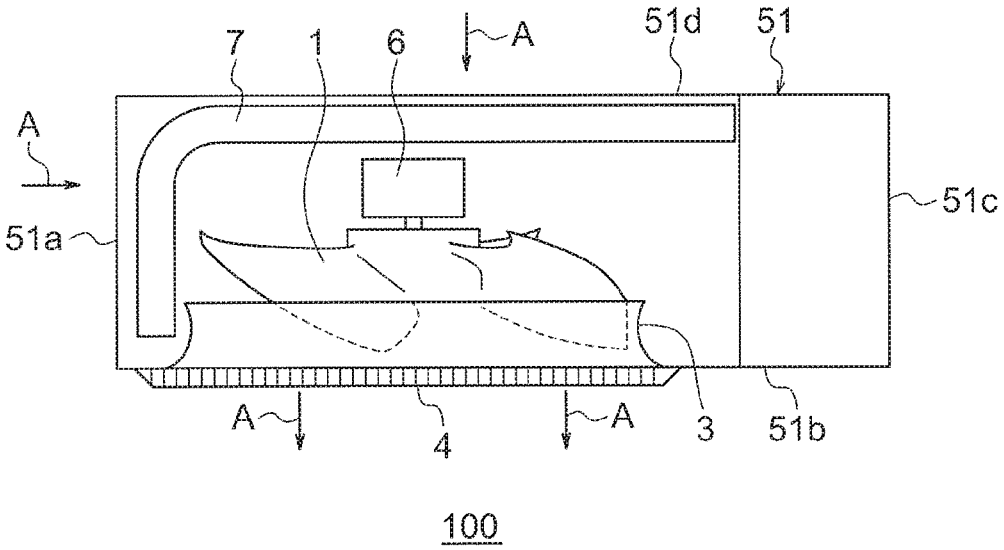
FIG. 2 is a plan view showing an internal structure of the air conditioner outdoor unit according to the first embodiment of the present invention.
Figure 3:
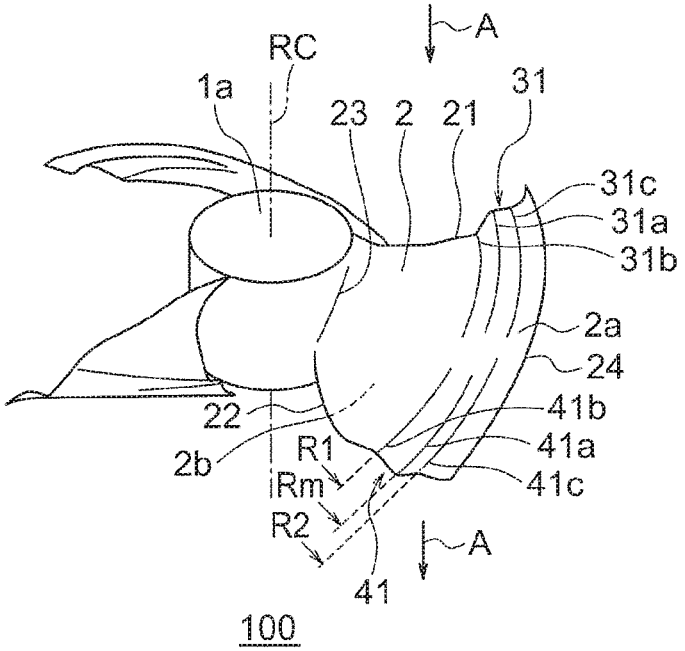
FIG. 3 is a perspective view of a propeller fan according to the first embodiment of the present invention.

FIG. 1 is a front view of an air conditioner outdoor unit according to a first embodiment of the present invention. FIG. 2 is a plan view showing an internal structure of the air conditioner outdoor unit according to the first embodiment of the present invention. FIG. 3 is a perspective view of a propeller fan according to the first embodiment of the present invention.

As shown in FIGS. 1 and 2, an air conditioner outdoor unit 100 has a case 51. The case 51 is formed as a case having a pair of left and right side surfaces 51*a* and 51*c*, a front surface 51*b*, a rear surface 51*d*, an upper surface 51*e*, and a bottom surface 51*f*. The side surface 51*a* and the rear surface 51*d* each have an opening to take in air from the outside (see the arrows A). A blowout port as an opening for blowing out air to the outside (see the arrows A) is provided at the front surface 51*b*, and a bell mouth 3 is provided and a lattice-shaped fan grill 4 is mounted at the blowout port.

The case 51 of the air conditioner outdoor unit 100 stores a propeller fan 1, a fan motor (driving source) 6, and a heat exchanger 7. The exemplary propeller fan 1 is connected with the fan motor 6 provided on the side of the rear surface 51*d* behind the propeller fan 1 and rotated by the driving force of the fan motor 6.

The heat exchanger 7 is provided in the vicinity of the side surface 51*a* and the rear surface 51*d* to extend substantially in an L-shape along the side surface 51*a* and the rear surface 51*d* in a plan view.

The bell mouth 3 is provided on the radially outer side of the propeller fan 1. The bell mouth 3 is in a loop (ring) shape in the rotation direction of the propeller fan 1.

Figure 6:
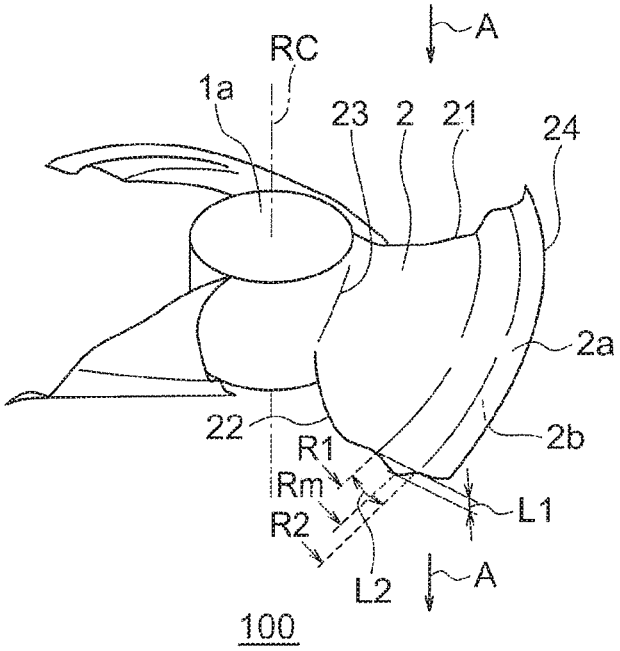
FIG. 6 is a perspective view of a propeller fan according to a second and a third embodiments of the present invention.

Note that the arrows A in FIGS. 2, 3, and 6 illustrate the flows of air only for the purpose of description and do not exactly indicate actual flows.

The propeller fan 1 includes a boss 1*a* and a plurality of blades 2. According to the first embodiment, the propeller fan 1 includes three blades 2 by way of illustration.

The boss 1*a* occupies the center part of the propeller fan 1. Stated differently, the rotation center line RC of the propeller fan 1 is through the boss 1*a*. The shape of the boss 1*a*, though not limited to a specific shape, may be in the shape of a column, a truncated cone, or a dome.

The three blades 2 are fixed at an outer peripheral surface of the boss 1*a*. The blades 2 are partly surrounded by the bell mouth 3 in a plan view. More specifically, the downstream part of each of the blades 2 enters the inside region of the bell mouth 3 which is surrounded by the bell mouth 3 in the plan view, and the upstream part of each of the blades 2 is outside the inside region of the bell mouth 3 surrounded by the bell mouth 3 in the plan view. More specifically, the upstream part of each of the blades 2 is positioned upstream of an upstream end (inlet end) of the bell mouth 3. The propeller fan 1 of this type is referred to as a "half-open type." The fan grill 4 is provided downstream of the propeller fan 1.

The three blades 2 according to the first embodiment have the same shape though the shape is not particularly limited according to the present invention, and therefore only one of the blades 2 will be described. The blade 2 has a first protrusion 31 that protrudes toward a negative pressure surface 2*a* side, at a leading edge 21 with respect to the rotation direction and/or a second protrusion 41 that protrudes toward a positive pressure surface 2*b* side, at a trailing edge 22 with respect to the rotation direction. Stated differently, in a range on the outer peripheral side of a position where the radius ratio is 0.5 in an area from an inner peripheral end 23 to an outer peripheral end 24 in the radial direction, the blade 2 has at least one shape among a shape such that a part of the leading edge 21 protrudes toward the side of the negative pressure surface 2*a*, and a shape such that a part of the trailing edge 22 protrudes toward the side of the positive pressure surface 2*b*. More specifically, the blade 2 has a first protrusion 31 having the leading edge 21 that partly protrudes toward the side of the negative pressure surface and a second protrusion 41 having the trailing edge 22 that partly protrudes toward the side of the positive pressure surface on the outer peripheral side of the position where the radius ratio is 0.5.

Here, the radius ratio refers to r/R where the distance from the rotation center line RC to the outer peripheral end 24 on a radial line is R and the radial distance from the rotation center line RC to an arbitrary position of the blade on the radial line is r as viewed in a plan view. Stated differently, in the range on the outer peripheral side of the position where the radius ratio is 0.5 in the area from the innermost periphery to the outermost periphery in the radial direction, the blade 2 has at least one shape among a shape such that the leading edge 21 locally protrudes toward the side of the negative pressure surface 2*a*, and a shape such that the trailing edge 22 locally protrudes toward the side of the positive pressure surface 2*b*. The illustrated blade 2 is formed to have both the leading edge 21 partly protruding toward the side of the negative pressure surface 2*a* and the trailing edge 22 partly protruding toward the side of the positive pressure surface 2*b*. Alternatively stated, the part of the leading edge 21 protrudes upstream in the blowing direction (the direction illustrated by the arrows A in FIG. 3) and the part of the trailing edge 22 protrudes downstream in the blowing direction as viewed in the extending direction of the rotation center line RC.

Furthermore, when the start and end of protrusion are defined in the radial direction from the inner side to the outer side, a maximum protrusion height position Rm of the protrusion of the leading edge 21 on the side of the negative pressure surface 2*a* and a maximum protrusion height position Rm of the protrusion of the trailing edge 22 on the side of the positive pressure surface 2*b* are both configured to be positioned on the outer peripheral side of the average radius between a protrusion start radius R1 and a protrusion end radius R2. In other words, in each of the first protrusion 31 and the second protrusion 41, the protrusion start radius R1 is set as a first base 31*b*, 41*b*, the protrusion end radius R2 is set as a second base 31*c*, 41*c*, and the maximum protrusion height position of each of the protrusions is set at the position of the protrusion tip end (maximum point). Then, when these positions are viewed in a projection in the direction of the rotation center line, the position of the protrusion tip end 31*a* of the first protrusion 31 is present on the outer peripheral side of the average radius between the radius of the first base 31*b* of the first protrusion 31 and the radius of the second base 31*c* of the first protrusion 31, while the position of the protrusion tip end 41*a* of the second protrusion 41 is present on the outer peripheral side of the average radius between the radius of the first base 41*b* of the second protrusion 41 and the radius of the second base 41*c* of the second protrusion 41. Further alternatively stated, the first protrusion 31 is provided in the range on the radially outer side of the center of the radial distance from the inner peripheral end to the outer peripheral end of the blade and has the protrusion tip end 31*a* with the maximum protrusion height, the first base 31*b* at the starting part of protrusion on the radially inner side of the protrusion tip end 31*a*, and the second base 31*c* at the starting part of protrusion on the radially outer side of the protrusion tip end, and the protrusion tip end 31*a* is positioned nearer to the second base 31*c* than to the first base 31*b* in the radial direction. The second protrusion 41 is provided in the range on the radially outer side of the center of the radial distance from the inner peripheral end to the outer peripheral end of the blade and has a protrusion tip end 41*a* with the maximum protrusion height, the first base 41*b* at the starting part of protrusion on the radially inner side than the protrusion tip end 41*a*, and the second base 41*c* at the starting part of protrusion on the radially outer side than the protrusion tip end. The protrusion tip end 41*a* is positioned nearer to the second base 41*c* than to the first base 41*b* in the radial direction.

Figure 4:
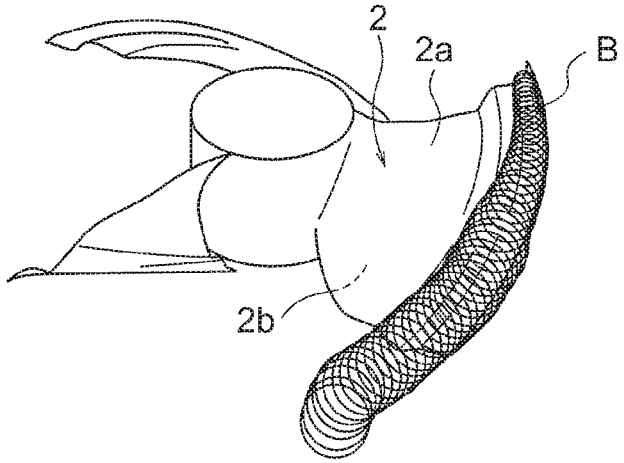
FIG. 4 is a perspective view of the flow of a blade tip vortex from a propeller fan.

Advantageous effects provided as a result of the above configuration will be described with reference to FIGS. 4 and 5. FIG. 4 is a view for illustrating the flow of a blade tip vortex from the propeller fan. With the half-open type propeller fan 1, a blade tip vortex B is generated in the vicinity of the outer peripheral end 24 of the blade. The blade tip vortex B is generated because pressure on the side of the negative pressure surface 2*a* of the blade 2 is lower than that on the side of the positive pressure surface 2*b* in the upstream part of the blade 2 positioned upstream of the upstream end of the bell mouth 3, and the generation region is on the outer peripheral side of the position where the radius ratio is 0.5. In the region passed by the blade tip vortex B, the flow velocity increases by the effect of the vortex.

Figure 5:
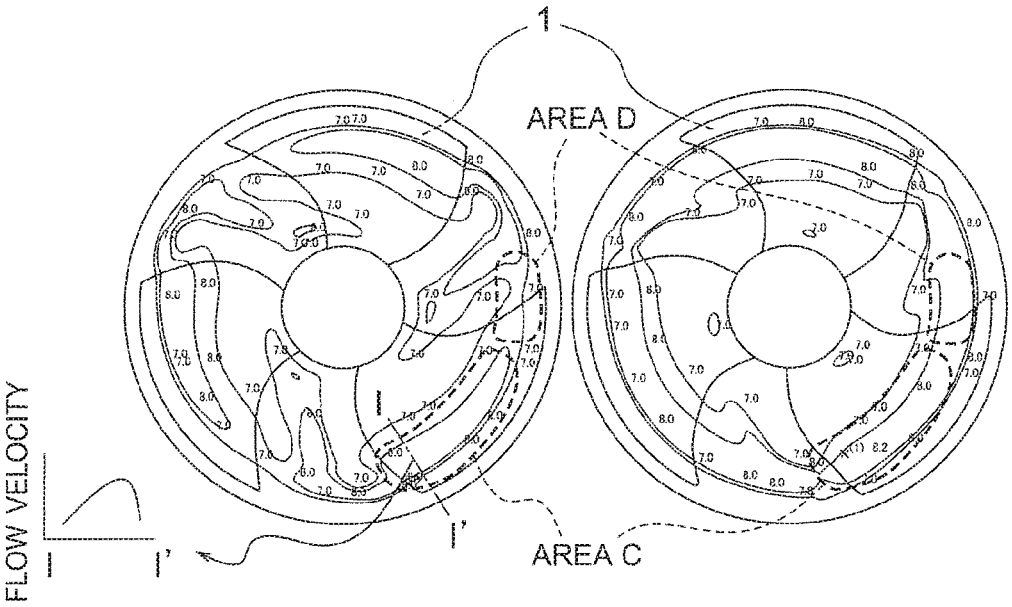
FIG. 5 is a view showing a wind velocity distribution downstream of the propeller fan.

FIG. 5 is a view showing a wind velocity distribution on the downstream side of the propeller fan, the left part of FIG. 5 illustrates a wind velocity distribution on the downstream side of a propeller fan in a comparative example, and the right part of FIG. 5 illustrates a wind velocity distribution on the downstream side of the propeller fan 1 according to the first embodiment of the present invention. Note that the propeller fan in the comparative example includes only blades with no protrusions on the side of the negative pressure surface at the leading edge and on the side of the positive pressure surface at the trailing edge. Contour lines in the figure illustrate a wind velocity distribution in a plane downstream of the propeller fan.

As shown in the left part of FIG. 5, with the propeller fan in the comparative example, a locally velocity-increased part appears in a region C because of the influence of the blade tip vortex B (see FIG. 4) that flows down in the downstream direction. Since the fan grill 4 is present downstream of the propeller fan 1, the presence of the locally velocity-increased part like the region C increases the velocity deviation of wind passing through the fan grill 4, and this increases pressure fluctuations on the surface of the fan grill 4, which is a cause for noise increase.

Meanwhile, as illustrated in the right part of FIG. 5, in the range on the outer peripheral side of the position where the radius ratio is 0.5 in the area from the radially inner peripheral end 23 to the radially outer peripheral end 24, the propeller fan according to the first embodiment of the present invention has at least one shape among a shape such that the leading edge 21 partly protrudes toward the side of the negative pressure surface 2*a*, and a shape such that the trailing edge 22 partly protrudes toward the side of the positive pressure surface 2*b*. As a result, the blade loading can be increased locally, and the wind velocity increases in a region D which is not passed by the blade tip vortex B in a radial region subjected to the locally increased velocity of the blade tip vortex B, so that the wind velocity difference between the regions C and D can be reduced.

As shown in the left part of FIG. 5, in the wind velocity distribution in the I-I' section, the velocity gradient on the outer peripheral side is greater than the velocity gradient on the inner peripheral side. Under the conditions, according to the first embodiment, the maximum protrusion height position Rm of the protrusion of the leading edge 21 on the side of the negative pressure surface 2*a* and the maximum protrusion height position Rm of the protrusion of the trailing edge 22 on the side of the positive pressure surface 2*b* are both configured to be positioned on the outer peripheral side of the average radius Ra between the protrusion start radius R1 and the protrusion end radius R2. As a result, the velocity gradient is efficiently eliminated while the blade loading can be increased locally, so that the wind velocity can be increased in the region D which is not passed by the blade tip vortex B in the radial region subjected to the local velocity increase of the blade tip vortex B, and the velocity difference between the regions C and D can be reduced. In this way, the velocity deviation of wind passing through the fan grill 4 can be reduced, and the surface pressure fluctuations at the fan grill 4 can be reduced, so that the noise can be reduced.

Note that the propeller fan 1 and the air conditioner outdoor unit according to the first embodiment may be configured with a blade having only one of the first protrusion 31 and the second protrusion 41, and still the same advantageous effects of the embodiment described above can be provided.

Second Embodiment

FIG. 6 is a perspective view of a propeller fan according to a second embodiment of the present invention. Note that the second embodiment is the same as the first embodiment except for the part that will be described in the following.

As shown in FIG. 6, in the blade 2 of the propeller fan 1, the shape of the protrusion part of the leading edge 21 on the side of the negative pressure surface 2*a* and the shape of the protrusion part of the trailing edge 22 on the side of the positive pressure surface 2*b* in the range on the outer peripheral side of the position where the radius ratio is 0.5 in the area from the radially inner peripheral end 23 to the outer peripheral end 24 has a characteristic section having a mild curve consisting of substantially arc curves in a section extending in the radial direction of the blade. More specifically, the shape of the protrusion on the side of the negative pressure surface 2*a* and the shape of the protrusion on the side of the positive pressure surface 2*b* are formed to have only the characteristic section as described above. Stated differently, the shape of the protrusion on the side of the negative pressure surface 2*a* and the shape of the protrusion on the side of the positive pressure surface 2*b* consist of curved surfaces without ridge lines.

With the above-described configuration, the blade loading can be increased locally without inducing discontinuity in the flow at the protrusions. Therefore, as shown in FIG. 5, in the radial region subjected to the local velocity increase of the blade tip vortex B, the wind velocity of the region D that is not passed by the blade tip vortex B can be increased, so that the wind velocity difference between the regions C and D can effectively be reduced. As a result, the velocity deviation of the wind passing through the grill 4 can be reduced and the pressure fluctuations at the grill surface can be reduced. Consequently, the noise can be further reduced.

Third Embodiment

A propeller fan according to a third embodiment of the present invention will be described with reference to FIG. 6. Note that the third embodiment of the present invention is the same as the first or second embodiment except for the part that will be described in the following.

As shown in FIG. 6, in a range of the blade 2 of the propeller fan 1 on an outer peripheral side of a position where the radius ratio is 0.5 in the area from the radially inner peripheral end 23 to the radially outer peripheral end 24, a maximum protrusion height L1 of the protrusion shape of a part of the leading edge 21 on the side of the negative pressure surface 2*a* and a maximum protrusion height L1 of the protrusion shape of a part of the trailing edge 22 on the side of the positive pressure surface 2*b* are configured to be smaller than the radial distance L2 from the protrusion start radius R1 to the protrusion end radius R2.

With the above-described configuration, abrupt change in the flow at the protrusions can be restrained while the blade loading can be increased locally, and as shown in FIG. 5, in the radial region subjected to the local velocity increase of the blade tip vortex B, the wind velocity of the region D which is not passed by the blade tip vortex B is increased, so that the wind velocity difference between the regions C and D is effectively reduced and the velocity deviation of the wind passing through the grill 4 can be reduced, so that the pressure fluctuations on the grill surface can be reduced and the noise can be even more reduced.

While the content of the present invention has specifically been described with reference to preferred embodiments thereof, various modifications will be apparent to those skilled in the art on the basis of the basic technical ideas and teachings of the present invention.

In the above description of the embodiments, the propeller fan is incorporated in an air conditioner outdoor unit, but the propeller fan according to the present invention is not limited to the arrangement. According to the present invention, a propeller fan device including the propeller fan, the bell mouth, and the fan grill described above can be embodied. The bell mouth surrounds the part of the propeller fan on the downstream side in the blowing direction in a plan view, the part of the propeller fan on the upstream side in the blowing direction is positioned outside the bell mouth in the plan view, and the fan grill is arranged downstream of the propeller fan in the blowing direction. The propeller fan is embodied as an air conditioner outdoor unit in combination with a heat exchanger in the above-described embodiment. As another example, the propeller fan device according to the present invention may be applied to a refrigeration cycle device such as a refrigeration device (a device that includes a refrigeration circuit including at least a compressor, a condenser, an expander, and an evaporator) other than the air conditioner, or may be embodied as a ventilator, a blower, and a dryer which do not need any heat exchange elements as a requirement.

while in the illustrated example as the best mode for carrying out the invention, three blades are shown by way of illustration, other than three blades may be provided according to the present invention, and the advantageous effects described above can also be provided in the configuration.

In the above-description of the embodiments, the blade is formed to have both the leading edge partly protruding toward the side of the negative pressure surface and the trailing edge partly protruding toward the side of the positive pressure surface, while the embodiment is merely an example of the invention, and the blade according to the present invention may have the configuration in which the protrusion is provided at the leading edge while the protrusion is not provided at the trailing edge, or alternatively the blade according to the present invention may have the configuration in which the protrusion is provided at the trailing edge while the protrusion is not provided at the leading edge.

REFERENCE SIGNS LIST

1 Propeller fan
1*a* Boss
2 Blade
21 Leading edge
22 Trailing edge
23 Inner peripheral end
24 Outer peripheral end
2*a* Negative pressure surface
2*b* Positive pressure surface
3 Bell mouth
4 Fan grill
7 Heat exchanger
31 First protrusion
31*a* Protruding tip end of first protrusion
31*b* First base of first protrusion
31*c* Second base of first protrusion 31
41 Second protrusion
41*a* Protruding tip end of second protrusion
41*b* First base of second protrusion
41*c* Second base of second protrusion

The invention claimed is:

1. A propeller fan, comprising:
a boss that rotates around a rotation axis; and
a blade fixed at an outer peripheral surface of the boss, wherein
the blade has a first protrusion that protrudes toward a negative pressure surface side, at a leading edge with respect to a rotation direction,
the first protrusion is provided in a range on a radially outer side of a center of a radial distance from an inner peripheral end to an outer peripheral end of the blade, and has a protrusion tip end with a maximum protrusion height, a first base at a starting part of protrusion on a radially inner side of the protrusion tip end, and a second base at a starting part of protrusion on a radially outer side of the protrusion tip end, and
the protrusion tip end is positioned nearer to the second base than to the first base in the radial direction.

2. The propeller fan of claim 1, wherein the first protrusion has a protrusion shape defined by a curved surface.

3. A propeller fan, comprising:
a boss that rotates around a rotation axis; and
a blade fixed at an outer peripheral surface of the boss, wherein
the blade has a protrusion that protrudes toward a positive pressure surface side, at a trailing edge with respect to a rotation direction,
the protrusion is provided in a range on a radially outer side of a center of a radial distance from an inner peripheral end to an outer peripheral end of the blade, and has a protrusion tip end with a maximum protrusion height, a first base at a starting part of protrusion on a radially inner side of the protrusion tip end, and a second base at a starting part of protrusion on a radially outer side of the protrusion tip end, and
the protrusion tip end is positioned nearer to the second base than to the first base in the radial direction.

4. The propeller fan of claim 3, wherein the protrusion has a protrusion shape defined by a curved surface.

5. The propeller fan of claim 1, wherein the protrusion tip end has a protrusion height less than a radial distance between the first base and the second base.

6. A propeller fan device comprising: the propeller fan of claim 1; a bell mouth; and a fan grill, wherein
the bell mouth surrounds a part of the propeller fan on a downstream side in a blowing direction in a plan view, a part of the propeller fan on an upstream side in the blowing direction is positioned outside the bell mouth in the plan view, and the fan grill is arranged downstream of the propeller fan in the blowing direction.

7. An air conditioner outdoor unit comprising the propeller fan of claim 1.

8. The propeller fan of claim 3, wherein the protrusion tip end has a protrusion height less than a radial distance between the first base and the second base.

9. A propeller fan device comprising: the propeller fan of claim 3; a bell mouth; and a fan grill, wherein
the bell mouth surrounds a part of the propeller fan on a downstream side in a blowing direction in a plan view, a part of the propeller fan on an upstream side in the blowing direction is positioned outside the bell mouth in the plan view, and the fan grill is arranged downstream of the propeller fan in the blowing direction.

10. An air conditioner outdoor unit comprising the propeller fan of claim 3.

11. The propeller fan of claim 1, wherein
the blade has a second protrusion at a trailing edge of the blade with respect to the rotation direction that protrudes toward a positive pressure surface side.

12. The propeller fan of claim 1, wherein
the first protrusion extends in an area of the blade having a radius ratio of 0.5 between the inner peripheral end and the outer peripheral end of the blade in the radial direction, and
the radius ratio is r/R, R is a distance from the rotation axis to the outer peripheral end along the radial line, and r is an arbitrary position on the blade along the radial line viewed in a plan view.

13. The propeller fan of claim 3, wherein the protrusion extends in an area of the blade having a radius ratio of 0.5 between the inner peripheral end and the outer peripheral end of the blade in the radial direction, and the radius ratio is r/R, R is a distance from the rotation axis to the outer peripheral end along the radial line, and r is an arbitrary position on the blade along the radial line viewed in a plan view.

* * * * *